US007965585B2

(12) United States Patent
Schiesser

(10) Patent No.: US 7,965,585 B2
(45) Date of Patent: Jun. 21, 2011

(54) RINGING MECHANISM

(75) Inventor: Alain Schiesser, Neuchatel (CH)

(73) Assignee: Christophe Claret SA, Le Locle (CH)

( * ) Notice: Subject to any disclaimer, the term of this patent is extended or adjusted under 35 U.S.C. 154(b) by 140 days.

(21) Appl. No.: 12/514,518

(22) PCT Filed: Nov. 7, 2007

(86) PCT No.: PCT/EP2007/061989

§ 371 (c)(1),
(2), (4) Date: May 12, 2009

(87) PCT Pub. No.: WO2008/061884

PCT Pub. Date: May 29, 2008

(65) Prior Publication Data

US 2010/0054091 A1 Mar. 4, 2010

(30) Foreign Application Priority Data

Nov. 21, 2006 (EP) ..... 06124443

(51) Int. Cl.
*G04C 23/00* (2006.01)
*G08B 9/00* (2006.01)

(52) U.S. Cl. ..... 368/269; 368/75; 116/25

(58) Field of Classification Search ..... 368/269–271, 368/72, 75; 116/25
See application file for complete search history.

(56) References Cited

U.S. PATENT DOCUMENTS

| | | | | |
|---|---|---|---|---|
| 2,000,327 | A | 5/1935 | Hansen | |
| 3,610,753 | A * | 10/1971 | Neubauer | 368/108 |
| 4,466,327 | A * | 8/1984 | Hinton | 84/95.2 |
| 6,826,122 | B2 * | 11/2004 | Zaugg | 368/28 |
| 6,847,589 | B2 * | 1/2005 | Wilmouth | 368/17 |
| 7,452,123 | B2 * | 11/2008 | Girardin et al. | 368/140 |
| 2006/0221775 | A1 * | 10/2006 | Zaugg | 368/127 |

FOREIGN PATENT DOCUMENTS

| | | |
|---|---|---|
| CH | 689 337 | 2/1999 |
| EP | 1 909 149 | 4/2008 |

OTHER PUBLICATIONS

International Search Report dated Feb. 14, 2008, from corresponding PCT application.

* cited by examiner

*Primary Examiner* — Sean Kayes
(74) *Attorney, Agent, or Firm* — Young & Thompson

(57) ABSTRACT

A ringing mechanism includes a power source (10) for driving rakes (18) and a gear (12) connecting the power source (10) to a regulation member (14), characterised in that the rakes (18) are kinetically connected to the power source (10) through a differential (20) provided in the gear (12).

19 Claims, 7 Drawing Sheets

RINGING MECHANISM

TECHNICAL FIELD

The present invention relates to the field of mechanical horology. It more particularly concerns a ringing mechanism comprising a power source for driving rakes and a gear connecting the power source to a regulation member.

PRIOR ART

This type of device is known, in particular in watches called grand strikes. These watches offer the possibility of ringing the passing hours, i.e. all of the quarters and/or all of the hours automatically. It is therefore obvious that, in order to do this, the wearer does not need to wind a barrel for each ringing, as is the case in the most common minute-repeaters, which only ring the hour on request and in which a ringing barrel is wound via a rack when the user actuates the control bolt.

Grand strikes are therefore equipped with a complete gear for driving the ringing parts. This gear therefore connects a ringing barrel provided with its own winding system to a regulation member. The barrel provides power to the ringing parts via a control and distribution member arranged in the gear, possibly coaxially to the barrel. The control and distribution member comprises a stack of several wheels, free or integral in rotation in relation to each other. Without explaining this device in detail, which is completely described in the work "Les montres compliquées" by F. Lecoultre, in Editions Horlogères, pages 182-205, we can summarize that clicks arranged in this member and controlled by levers make it possible to manage the various steps of the progress of the ringing.

The aim of the present invention is to propose an advantageous alternative to the devices of the prior art.

BRIEF DESCRIPTION OF THE INVENTION

More precisely, in a ringing mechanism according to the concerned invention, the ringing parts are kinematically connected to the power source via a differential provided in the gear.

Advantageously, this differential comprises a first input wheel kinematically connected to the gear and a second input wheel connected to a control member, and an output wheel connected to the ringing parts.

The control member is arranged such that the differential can occupy:

- a first configuration in which the first input wheel is blocked in rotation and the second input wheel is free in rotation, the output wheel being free in rotation,
- a second configuration in which the first input wheel is free in rotation, the second input wheel is blocked in rotation, the output wheel then being free to be driven via the first input wheel, and
- a third configuration in which the first and the second input wheels are blocked in rotation, the output wheel also being blocked in rotation.

In one preferred embodiment, the differential comprises:

- a first solar wheel constituting the first input of the differential and kinematically connected with a wheel of the gear,
- at least one lower satellite meshing with the first solar wheel,
- a satellite-holder wheel free in rotation and coaxial with the solar wheel, constituting the second input of the differential, said lower satellite being mounted in rotation on a first level of the satellite-holder wheel,
- at least one upper satellite mounted in rotation on a second level of the satellite-holder wheel, mounted coaxial and integral in rotation with the lower satellite,
- an upper solar wheel, meshing with the upper satellite and constituting the output of the differential.

Preferably, the control member is a camshaft comprising a first cam to block the first input wheel or leave it free in rotation, a second cam to block the second input wheel or leave it free in rotation and at least one drive train for the pivoting of the shaft.

In order to offer the user the possibility of deactivating the ringing, the mechanism can comprise a silencing device provided with a bolt which can evolve between first and second positions, in which it cooperates with the drive train in order to block the control member. This bolt can be moved by manual control means, activated by the wearer, or by automatic control means, for example to prevent ringing from triggering itself below a certain power reserve as a time goes by.

BRIEF DESCRIPTION OF THE DRAWINGS

Other characteristics will appear more clearly upon reading the following description, done in reference to the appended drawing, in which.

DETAILED DESCRIPTION OF THE INVENTION

The different elements described and/or shown are mounted on a frame made up of a plate and bridges. In order to facilitate reading of the drawings, the plate, bridges and pivots are not illustrated.

Figure 1:
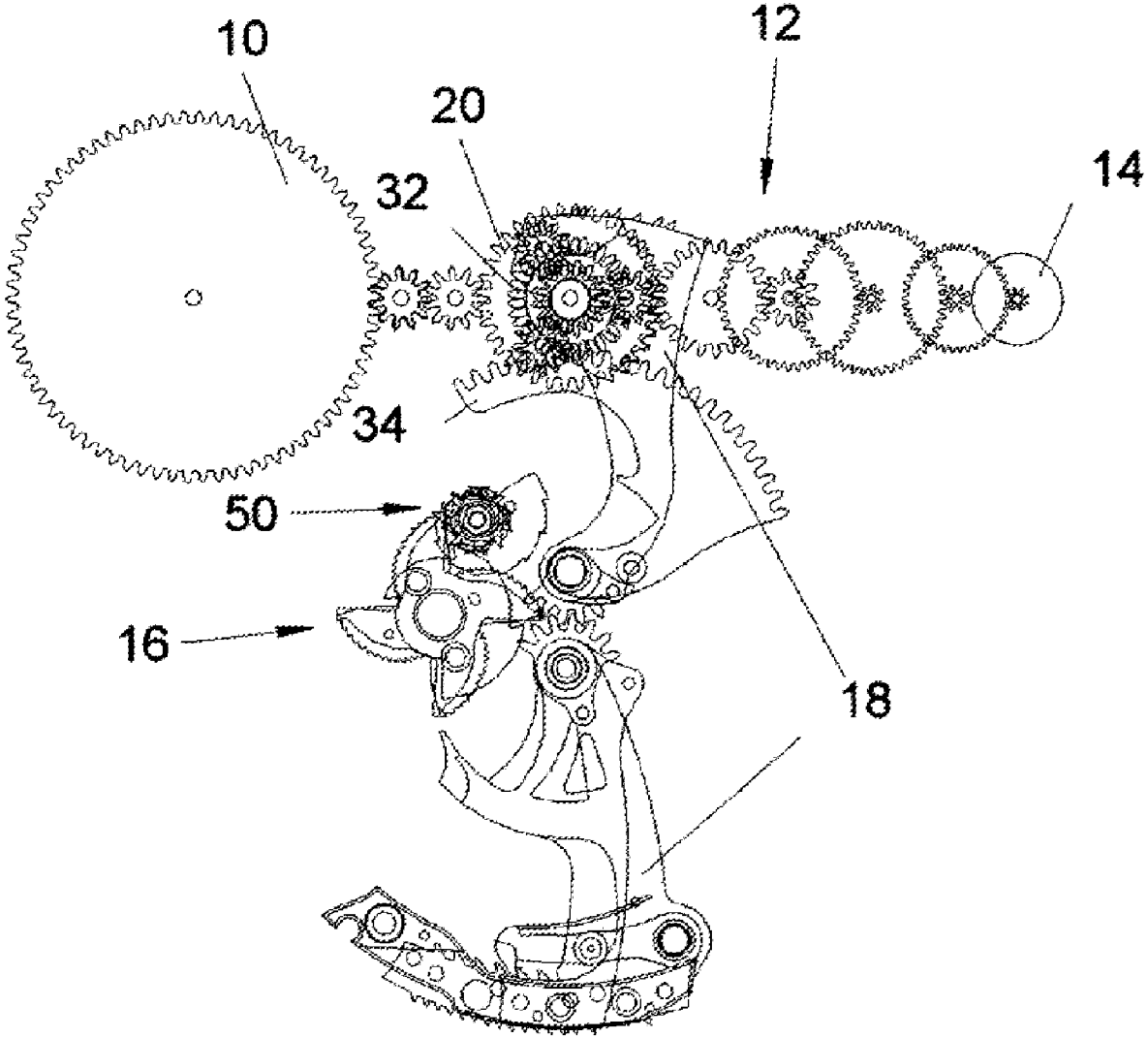
FIG. 1 is an overall view of the ringing mechanism, its power source and the gear connecting them.

FIG. 1 shows a barrel 10 whereof the winding system has not been illustrated, which drives a reduction gear train 12, which ends with a regulation member, for example a flywheel 14 provided with an inertia-block brake as known by those skilled in the art.

FIG. 1 also illustrates ringing parts comprising:

- a series of snails 16 driven by the basic movement of the timepiece in which the mechanism is mounted, and supplying information on the current time, and
- rakes 18 arranged to cooperate with these snails 16 in order to actuate hammers striking on gongs in order to produce a ringing identifying the current time.

This mechanism not being directly the object of the invention, it will not be described in detail. One may refer to application EP 06121650.3, which describes it completely. The rakes could also be part of a more conventional mechanism as described in the aforementioned work or in the book "Théorie de l'horlogerie" by Reymondin et al, Fédération des Ecoles Techniques, 1998, ISBN 2-940025-10-X, pages 219 to 224.

Particularly to the invention, a differential 20 kinematically connects the gear 12 to the rakes so that they are driven by the barrel 10 during the ringing.

Figure 2:
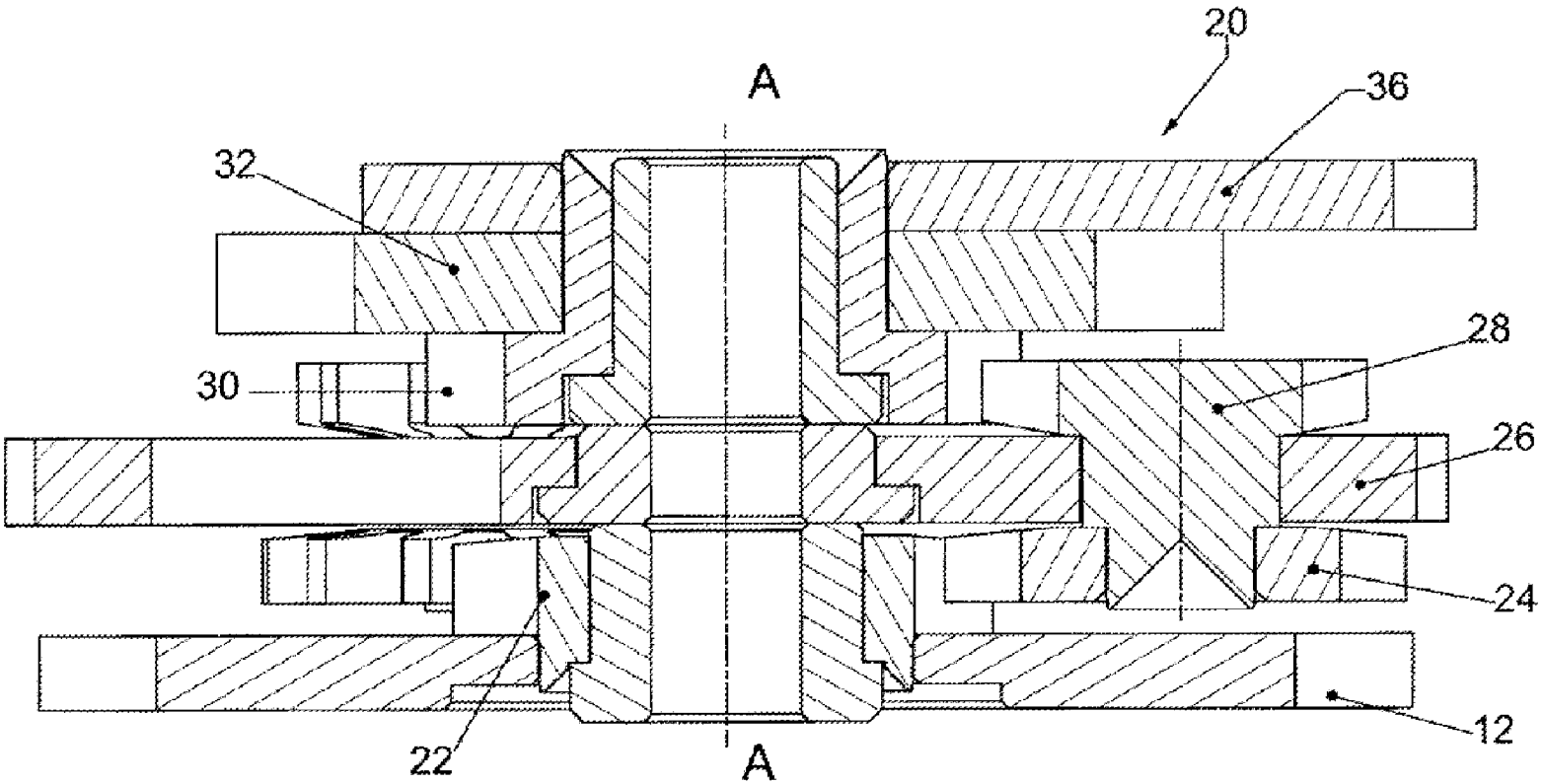
FIG. 2 is a cross-sectional view of the differential preferably used in the mechanism according to the invention.

An example of differential 20 particularly adapted to the invention is shown in FIG. 2. On an arbor with an axis A-A, it comprises a first solar wheel 22 constituting a first input of the differential and kinematically connected with a wheel of the gear 12. According to the example, the differential 20 is coaxial to and integral with this wheel of the gear 12. This solar wheel 22 meshes with at least one, typically three, lower satellites 24 mounted in rotation on a first level of a satellite-holder wheel 26 provided with a peripheral toothing. The latter constitutes a second input of the differential. It is free in rotation and coaxial with the solar wheel 22. The three lower satellites 24 are each mounted coaxial to and integral in rotation with at least one, typically three, upper satellites 28 mounted in rotation on a second level of the satellite-holder wheel 26. The upper satellites 28 mesh with an upper solar wheel 30, coaxial to and integral in rotation with a setting-wheel 32. This upper solar wheel 30 constitutes the output of the differential.

As one can see in FIG. 1, this setting wheel 32 is engaged with a toothed sector 34 of an hour feeler-spindle, designed to cooperate with the hour snail. An hour ratchet 36, designed to actuate a lift in order to strike the hours, is also integral in rotation with the setting wheel 32. The hour ratchet 36 is therefore directly kinematically connected to the hour feeler-spindle.

Thus, it appears that the differential can occupy three different useful configurations by acting on the two inputs.

A first configuration in which the satellite-holder wheel 26 is free in rotation and in which the lower solar wheel 22 is blocked: the upper solar wheel 30 and the elements integral therewith are free to turn. The satellites 24 and 28 indeed turn around the axis A-A of the differential 20 because the lower satellites 24 roll on the lower solar wheel 22, which is blocked.

A second configuration in which the satellite-holder wheel 26 is blocked in rotation and the lower solar wheel 22 is free to be driven by the train 12: the upper solar wheel 30 is then free to be driven by the train. Indeed, in this case, the satellites behave like a simple vertical setting wheel and transmit the rotation of the lower solar wheel 22 to the upper solar wheel 30.

A third configuration in which the satellite-holder wheel 26 and the lower solar wheel 22 are blocked in rotation: the upper solar wheel 30 is also blocked, because of this, in rotation. The satellites 24 and 28 cannot, in this case, turn on themselves or turn around the axis A-A of the differential.

One therefore understands that, in the first configuration above, the rakes 18 kinematically connected to the hour feeler-spindle can move independently of the train 12 and the barrel 10. This configuration is that which is used, during triggering of the ringing, to allow the feeler-spindles of the different rakes to fall on their respective snails in order to get information relative to the current time. The second configuration makes it possible to kinematically connect the barrel 10 to the rakes 18. It is therefore this configuration which is used during the progress of the ringing so that the rakes move relative to their lift in order to actuate the hammers. Lastly, the third configuration corresponds to the situation in which the rakes 18 are stopped and kept locked.

Figure 6:
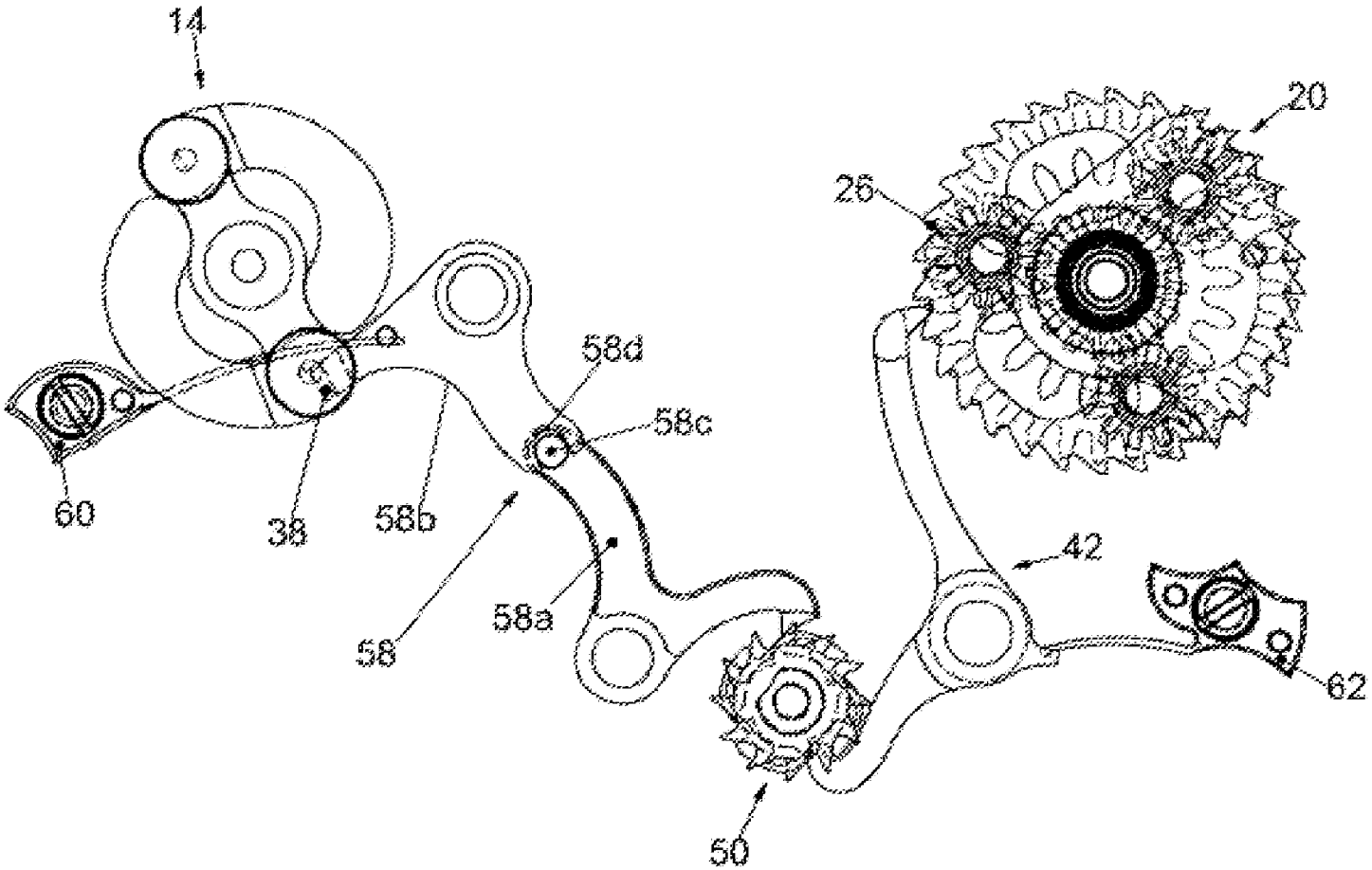

As one will understand better in the continuation of the description, the blockage of the lower solar wheel 22 is done, according to the preferred embodiment illustrated in the drawings, by blocking the unwinding of the ringing barrel 10. Advantageously, this blockage is obtained by a banking element 38 arranged so as to evolve between first and second extreme positions, the stop element 38 crossing, in one of these extreme positions, the journey of a pin 40 mounted protruding on the regulation member 14. It is in fact at this location of the gear that the torque is the least significant and the blockage can be done with optimal security. These elements are visible in FIG. 6 and their actuation will be described below.

Figure 3:
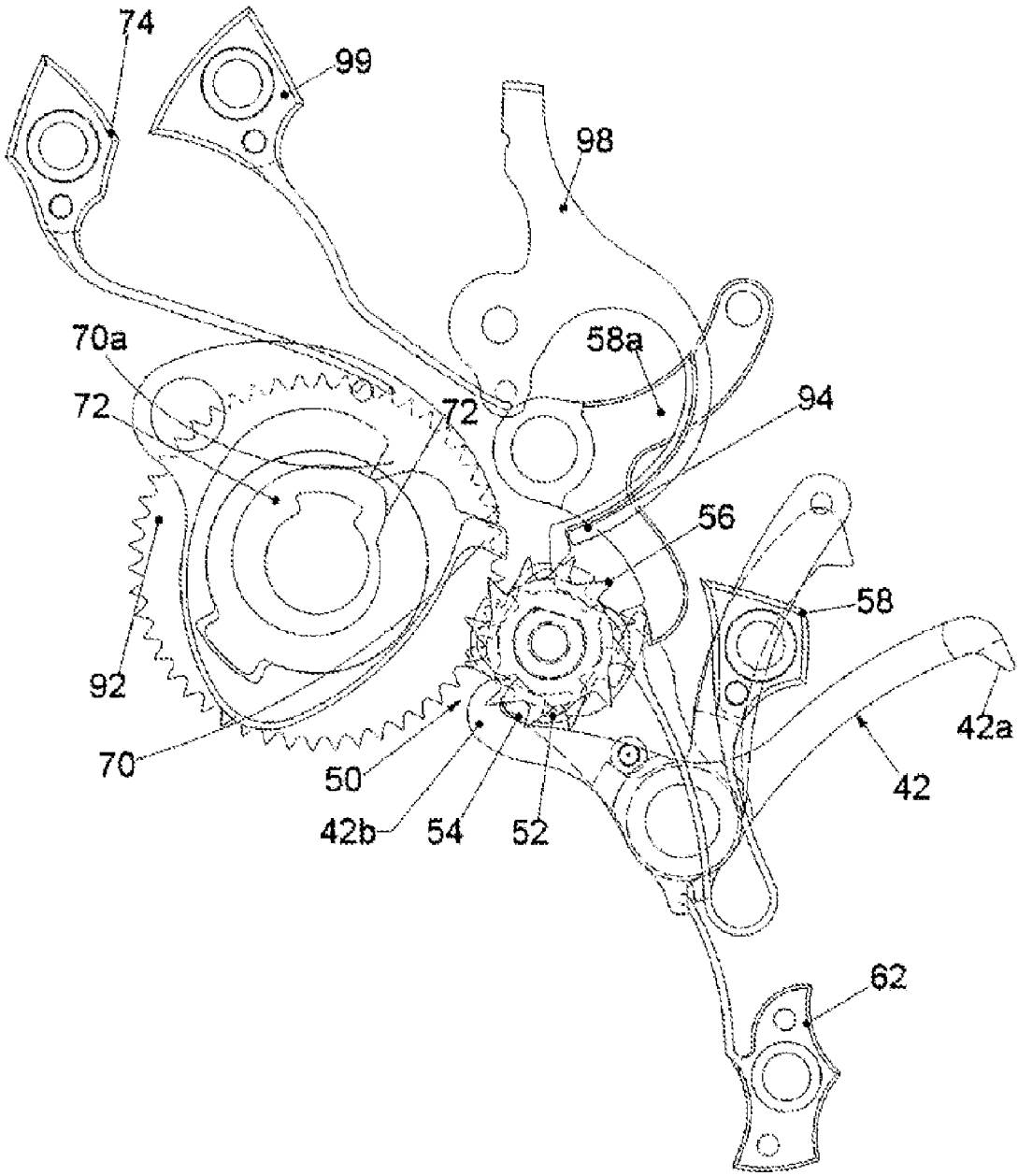
FIGS. 3 to 6 are views of the control member which governs the different positions of the differential.

One can see in FIG. 3 that the blockage of the satellite-holder wheel 26 is done directly via a bolt 42, having the form of a hook 42*a* arranged on a lever 42*b* and capable of evolving between first and second extreme positions, the hook 42*a* cooperating with the toothing of the satellite-holder wheel 26 when it is found in one of these extreme positions.

We will now examine the manner in which the banking element 38, on one hand, and the bolt 42, on the other hand, are controlled so that they each evolve between their first and second extreme positions, in a coordinated manner.

A camshaft 50, particularly visible in FIG. 3, is mounted pivoting in the frame and comprises a first cam 52 designed to control the blocking of the lower solar wheel 22 and a second cam 54 controlling the blocking of the satellite-holder wheel 26.

The cams and the stars are shown individually in FIG. 4. The camshaft 50 is positioned by a first star 56 comprising a first level 56*a* (FIG. 4*a*) provided with twelve teeth cooperating with a jumper 58 and a second level 56*b* (FIG. 4*b*) only comprising four teeth, regularly distributed on a cutting of twelve teeth and superimposed with the teeth of the first level. This star 56 also performs the function of drive train for the shaft 50, as will be described in detail below.

Because the operation of the differential involves three configurations, the positioning star 56 is numbered according to a multiple of three, twelve having an advantageous angular pitch between two consecutive positions in relation to the size of these parts and the available space.

Figure 4D:
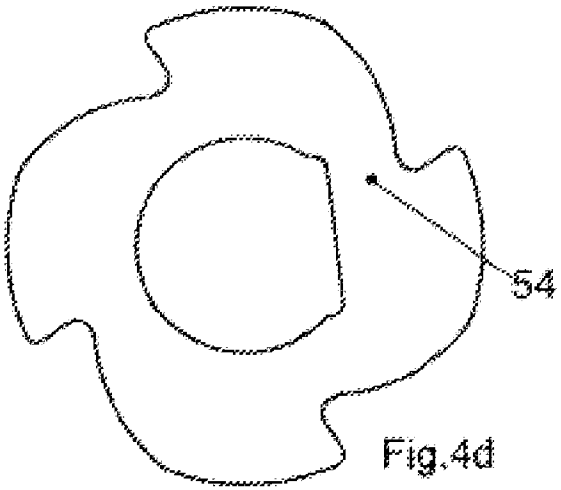
Figure 4B:
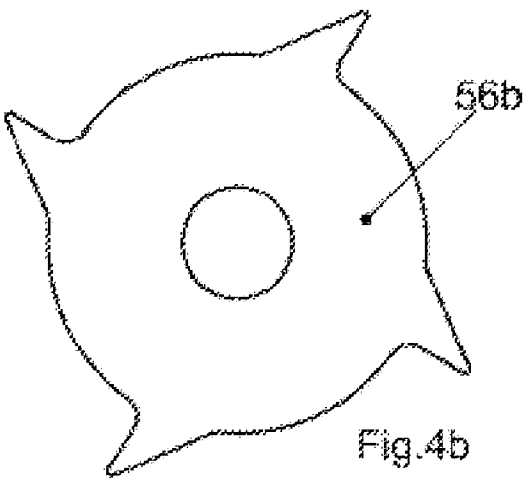
Figure 4C:
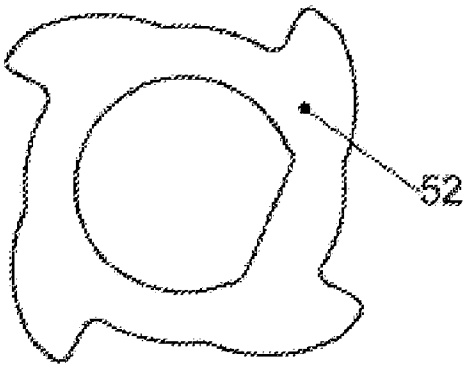
Figure 4A:
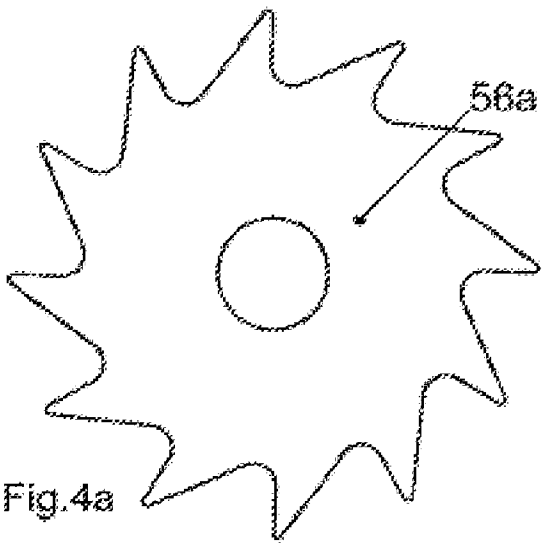
Figure 4E:
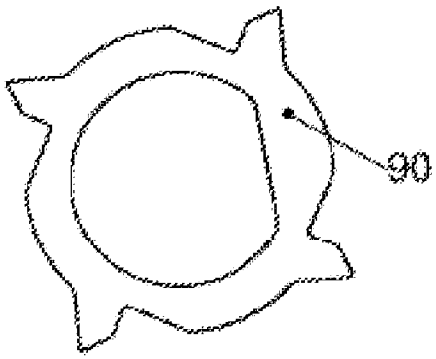

The first cam 52, shown in FIG. 4*c*, has a succession of protruding parts and hollow parts. As mentioned above and illustrated by FIG. 6, blocking of the lower solar wheel 22 is done at the regulation member 14. The banking element 38 can be arranged at the end of a double lever 58, comprising two levers 58*a* and 58*b* articulated with each other by a post 58*c* integral with one of them 58*a* and cooperating with a housing 58*d* arranged in the other 58*b*. A spring 60 is arranged so as to push the end of the lever 58*a* against the first cam 52. The pivot points of the double lever 58 are arranged, in the example, such that, when the lever 58*a* pushes against a protruding part of the cam 52, the banking element 38 cooperates with the regulation member 14, which blocks the lower solar wheel 22. Conversely, when the cam 52 has a hollow part at the lever 58*a*, the lower solar wheel 22 is free. Thus, for a ringing cycle, the cam 52 is provided with a succession of a protruding part, a hollow part and a protruding part, this series being repeated four times according to the example of a twelve-position camshaft 50.

The second cam 54 (FIG. 4*d*) also has a succession of protruding parts and hollow parts. A spring 62 is arranged so as to push the end of the lever 42 not bearing the hook 42*a* against the cam 54. In the example, the pivot point of the lever 42 is arranged such that, when the cam 54 has a protruding part at the lever 42, the hook 42*a* is outside the toothing of the satellite-holder wheel 26 which is therefore free in rotation. Conversely, when the lever 42 pushes against a hollow of the cam, the satellite-holder wheel 26 is blocked. Thus, for a ring cycle, the cam 54 is provided with a succession of one protruding part and two hollow parts, this series being repeated four times according to the example of a twelve-position camshaft.

One skilled in the art will know how to coordinate the two cams so as to have the following positions:

| Configuration | First cam | Lower solar wheel | Second cam | Satellite-holder wheel |
|---|---|---|---|---|
| 1 | Protruding | Blocked | Protruding | Free |
| 2 | Hollow | Free | Hollow | Blocked |
| 3 | Protruding | Blocked | Hollow | Blocked |

In order to explain how the camshaft 50 is driven to go from one configuration to the other, we will start from configuration 3 in which the rakes 18 are locked. The passage to configuration 1 takes place upon triggering of a ringing, either as the time passes, or upon request.

For triggering upon passage, one can refer to FIG. 3, which shows a flexible finger 70 designed to cooperate with the second level 56*b* of the star 56 and driven in rotation by the basic movement of the timepiece. For example, the finger 70 performs one to-and-fro motion under the action of a socket 72 whereof the perimeter defines a sort of snail and comprises a slanted plane 72*a*. The finger 70 is kept pushed against the cam by a spring 74 at a lug 70*a* with which it is provided. The socket is driven, in the counterclockwise direction in relation to FIG. 3, by the minute wheel of the basic movement, at a rate of one revolution per hour, which causes the finger 70 to pivot in the counterclockwise direction and wind the spring 74. Every hour, as the hour passes, the lug passes the slanted plane and the finger 70, under the effect of the spring 74, pivots in the clockwise direction and drives the star 56 by one pitch, thereby causing the differential to pass to configuration 1.

The socket 72 could thus comprise a plurality of slanted planes so as to actuate the finger every quarter hour, to ring the quarters, a lifting-lever then possibly being provided if it is desired that the hours not be struck upon striking of the quarters.

Figure 5:
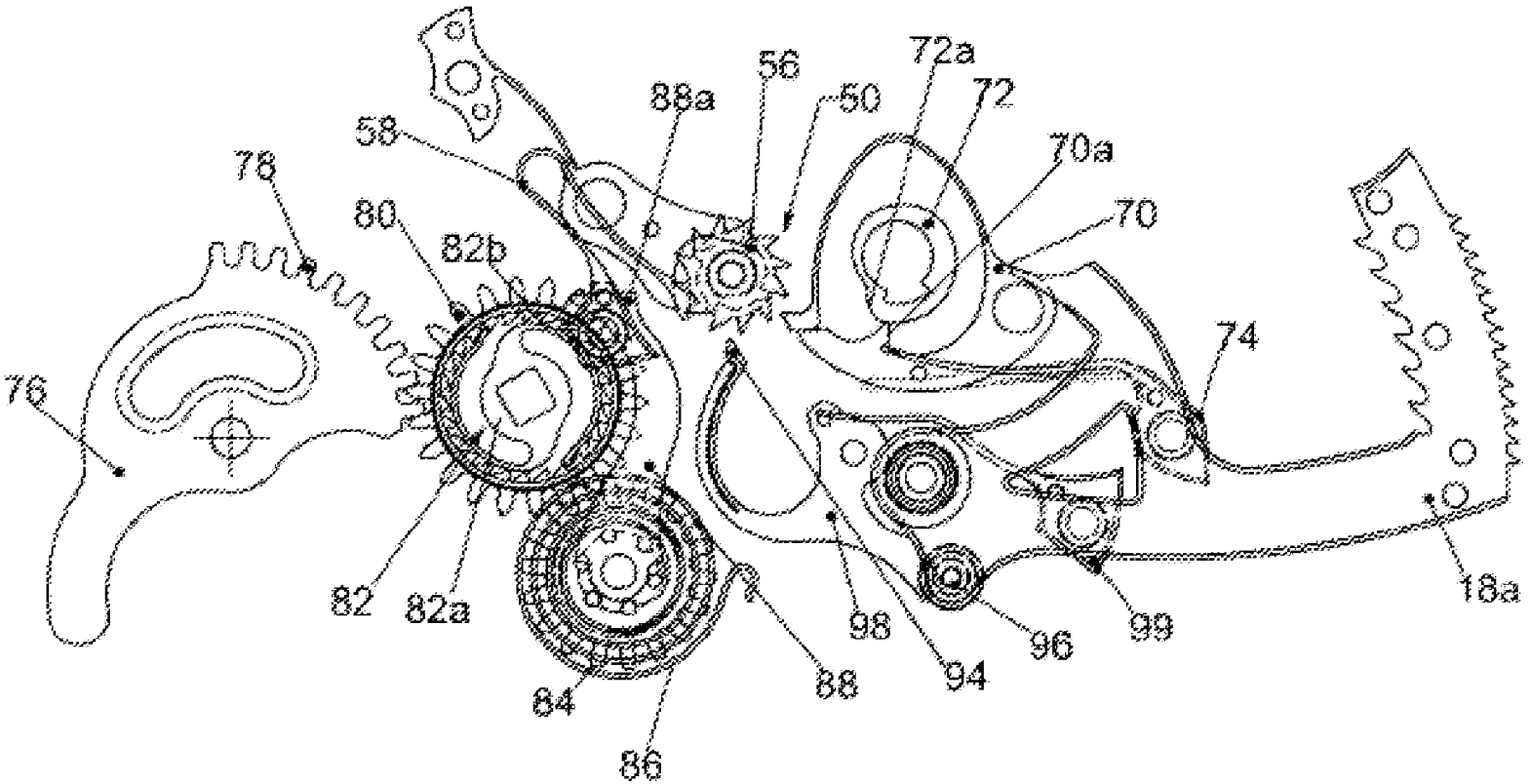

For a manual triggering, we will refer to FIG. 5. It is proposed that the user actuate a bolt 76 integral with a rack 78, like a conventional minute repeater. The rack 78 meshes with an outer toothing of a ring 80, coaxial with the ringing barrel 10. This ring 80 is connected to the arbor of the barrel 10 by a radial spring 82 having a hub 82*a* mounted square on the arbor and typically two elastic blades 82*b*, exerting radial pressure toward the outside of the wheel and ending with a toothed portion cooperating with an inner toothing comprised by the ring 80. The spring 82 and the inner toothing of the ring 80 are arranged so as to form a click between the arbor of the barrel 10 and the rack 78. Thus, pivoting of the ring 80 in one direction drives the barrel arbor in rotation, but neither the pivoting of the barrel arbor in the other direction, for example during disassembly of the movement, nor driving of the arbor during manual winding of the ringing barrel causes movement of the bolt 76.

The outer toothing of the ring 80 transmits the movement of the bolt to a wheel 84 with which it meshes. This wheel 84 is provided with a return system 86, for example a balance spring, allowing the bolt 76 to return to its locked position since the aforementioned click system does not allow this return to be ensured by the power supplied by the barrel 10, as is the case in classic repeaters. The wheel 84 also supports an arm 88 mounted on its axis and ending with a support zone 88*a* designed to cooperate with a second star 90 (FIG. 4*e*), also playing the role of drive element for the arbor 50, in order to advance the camshaft 50 by one pitch and cause the differential to go to configuration 1. This star 90 is sized on the number twelve but only comprises four teeth, i.e. one per ringing cycle. It is also very visible in FIG. 7.

This manual trigger device is the object of a patent application having the same filing date as this application and in which it is described in more detail.

In a simplified version, one may provide that a simple lever driven by a button arranged in the middle of the watch drives the star 90 by one pitch, without rewinding the barrel.

For the passage of the camshaft to position 2, the teeth of the star 90 are capable of crossing the path of a transmission wheel 92, put in continuous rotation by the main train of the movement. Typically, this wheel is driven by the third wheel at a rate of one revolution in approximately thirty seconds. One skilled in the art will know how to determine the shape of the teeth of the star 90 and of the transmission wheel 92 in order to ensure good transmission of the torque.

More particularly, the teeth of the star 90 are arranged on the camshaft so as to cross the path of the transmission wheel 92 when the differential is in its first configuration. The camshaft 50 is therefore driven slowly by one pitch and causes the differential 20 to pass to configuration 2.

One will recall that, in configuration 2, the rakes 18 are kinematically connected to the barrel 10 so as to allow the progress of the ringing as such. The shaft 50 must therefore advance one additional pitch only at the end of the ringing.

In order to do this, one of the rakes 18, preferably the minute rake 18*a*, since it is the last part which comes into play in the ringing, or a part which is kinematically connected thereto, allows the movement of a transmission element at the end of the ringing. In reference to FIG. 5, this element can be a finger 94 arranged so as to cooperate with the first star 56 in order to cause the camshaft 50 to advance by one pitch. In this case, the minute rake 18*a* supports a pin 96 designed to drive the finger 94. Advantageously, this finger 94 is located at the end of an elastic portion of a lever 98, which improves the safety of the device. A spring 99 keeps the lever 98 bearing against the pin 96. Thus, at the end of ringing, the camshaft 50 advances one pitch, which allows the differential to go to configuration 3. A new ringing cycle can begin.

To summarize, when the ringing is idle, the differential 20 is in its configuration 3, the barrel 10 being locked, and the rakes 18 thus being held in position. When the ringing is triggered, either manually or due to the passage of time, the camshaft 50 is driven by one pitch, which allows the differential 20 to be brought to its configuration 1. The rakes are then disconnected from the ringing gear 12 and they can then fall freely, under the effect of their respective springs, on their snails in order to get information relative to the current time. This step is very fast and takes place while the transmission wheel 92 drives the second star 90 and causes the differential 20 to pass to its configuration 2. The rakes are then kinematically connected to the barrel 10, which is released. The direction of movement of the rakes then reverses and their toothed sector actuates the lifts and the hammers in order to produce the ringing. Lastly, at the end of the ringing, the pin 96 causes the camshaft 50 to advance one additional pitch such that the mechanism is again in its locked position.

One will note that, thanks to the fact that the finger 70 cooperates with the second level 56*b* of the star 56, if a triggering due to the passage of time occurs during the progress of a ringing which has just been triggered manually, then the finger 70 will only find a space without teeth on its path and will not abut against the camshaft. This security is particularly advantageous because attempting to trigger ringing due to the passage of time while ringing is already in progress would cause serious damage to the mechanism.

The same effect is obtained for manual triggering thanks to the structure of the star 90. If manual triggering takes place during the progress of ringing which has just been triggered manually or due to the passage of time, then the arm 88 will only find a space without teeth on its path and will not abut against the shaft 50. Combined with the manual winding system described above, it is even possible to wind the barrel 10 only via the bolt, either during ringing, or by adjusting the path of the bolt so as not to trigger ringing.

Figure 7:
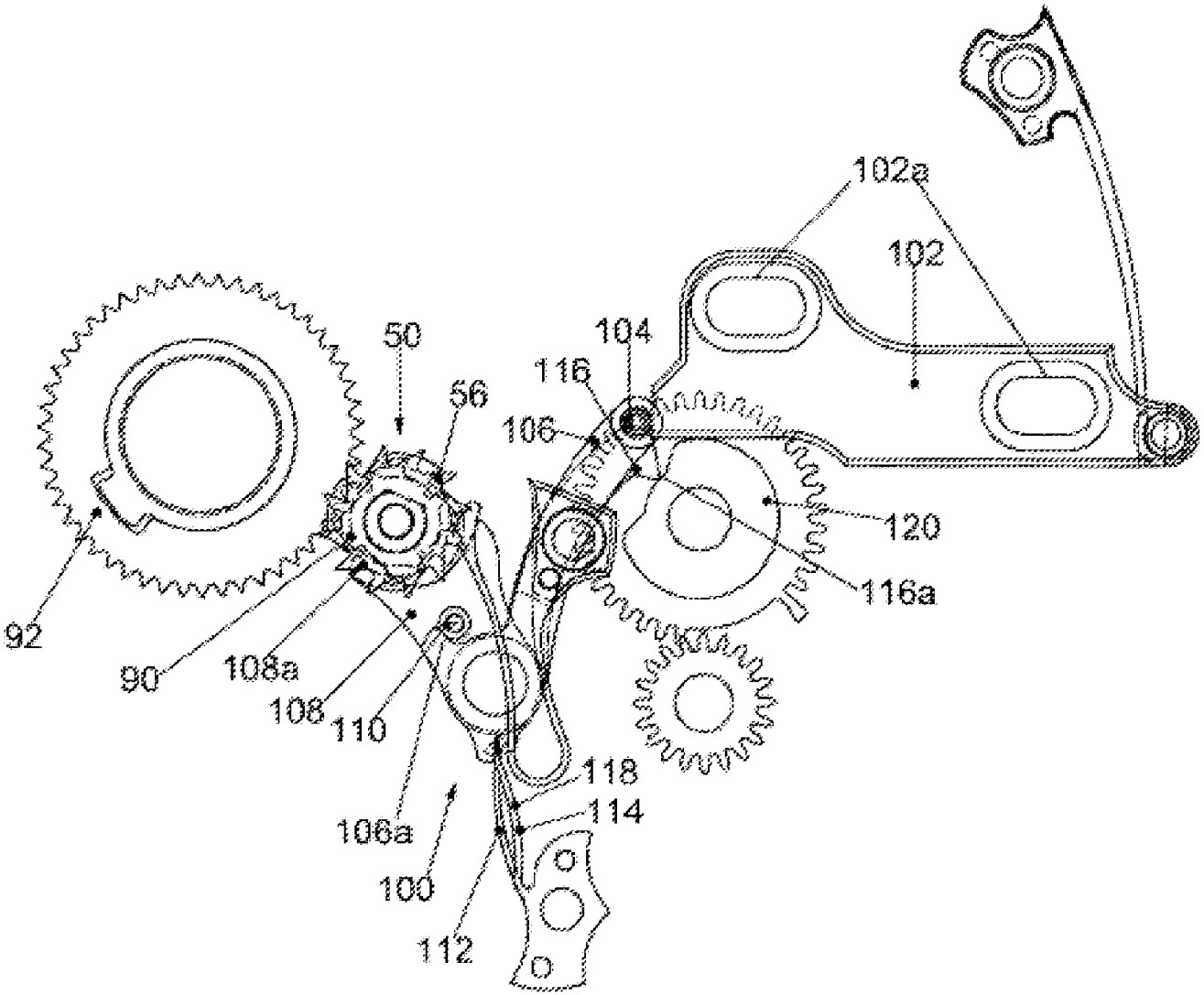
FIG. 7 shows different possibilities and safety devices which the system may comprise.

The mechanism according to the invention can, furthermore, comprise a silencing device 100 illustrated in FIG. 7 and which allows the user to prevent triggering of the ringing due to the passage of time. To this end, a button or a corrector (not shown) is arranged in the middle of the watch and causes a slide-way 102 to evolve between a first, idle position and a second position. This slide-way 102 is mounted mobile in translation on the plate of the ringing mechanism and comprises, for this purpose, two oblong parts 102*a* in which shouldered screws pass.

The slide-way 102 cooperates with a post 104 arranged on a lever 106. A bolt 108 is mounted pivoting, coaxial to the lever 106. The bolt 108 is arranged so as to be able to evolve between a first, idle position and a second position in which it cooperates with the second star 90, in order to prevent the rotation of the shaft 50. More particularly, the bolt 108 has a hollow which substantially fits the circumference of the camshaft. The hollow defines a finger 108*a* capable of interacting with the teeth of the star 90. These teeth are formed so as to bear substantially orthogonally on the finger 108*a*, in order to obtain effective blocking.

The bolt 108 is provided with a pivot-shank 110 capable of cooperating with a support surface 106*a* presented by the lever 106. A first spring 112 keeps the pivot-shank 110 bearing against the surface 106*a*. The force exerted by this spring 112 on the bolt tends to distance the camshaft 50 and bring it back to its first position. A second spring 114 is arranged so as to stick the lever 106 against the slide-way 102.

In the illustrated embodiment, the finger 108*a* blocks the rotation of the shaft 50 when the slide-way 102 is pulled, i.e. when it is in its most distant position in relation to the shaft 50. The extreme positions of the slide-way 102 can be marked by a notch system, advantageously obtained at the corrector or the button. Thus, when the user actuates the corrector so as to pull the slide-way 102, the lever 106 pivots and, the spring 112 being weaker than the spring 114, the bolt 108 is brought into its second position and blocks the pivoting of the camshaft 50. Inversely, when the slide-way 102 is pushed, the bolt 108 returns to its first position under the effect of the spring 112, releasing the camshaft 50.

Thanks to the fact that the bolt 108 and the lever 106 are not integral, the bolt 108 can be brought into its second position by another device. Thus, a second lever 116 is also mounted coaxial in relation to the first. This second lever 116 is provided with a feeler-spindle 116*a* maintained by a third spring 118 bearing against a cam 120 performing one revolution, substantially in a time period equal to the power reserve of the ringing barrel 10. The cam 120 has a hollow arranged so as to be present at the lever when the power reserve of the barrel is below a predetermined threshold.

When the power reserve of the barrel 10 falls below this predetermined threshold, the lever 116 pivots and, the spring 112 being weaker than the spring 118, the bolt 108 is brought into its second position and blocks the pivoting of the camshaft 50. Inversely, when the power reserve returns above the predetermined threshold, the bolt returns to its first position under the effect of the spring 112, releasing the camshaft 50.

In the case where the manual triggering system for the ringing makes it possible to rewind the ringing barrel 10, it is useful to provide that the ringing can take place, even if the silencing device 100 is set. To this end, upon manual triggering, the arm 88 actuating the star 90 is arranged so as to cross, in its journey, the bolt 108 if the latter is in its second position, so as to bring it into its first position for the time needed to cause the shaft 50 to advance. This release must take place before the arm 88 exerts a push on the star 90. Then, once the shaft has pivoted, given that the bolt is found across from portions of the star 90 without teeth, it no longer exerts blocking, until, at the end of the ringing, it cooperates with a next tooth.

One skilled in the art may provide other cams to actuate the silencing device. For example, a cam driven by the gear of the basic movement at a rate of one revolution per twenty-four hours can define parts of the day during which ringing due to the passage of time is triggered and others, for example during the night, during which it is blocked.

Thus is proposed a new ringing mechanism making it possible to manage the different steps of the progress of the ringing, particularly in a grand strike, i.e. in a striking-mechanism making it possible to strike the hours due to the passage of time or upon request. The embodiment presented above is only a non-limiting illustration of the invention, the main aspect of which is to use a differential to manage the steps of the ringing. One skilled in the art can easily adapt various connecting elements between the control member and the inputs of the differential without going beyond the scope of the invention. He may also find solutions other than those proposed in order to make the camshaft advance. Thus, instead of using a transmission wheel to cause the shaft to go from its first to its second configuration, one can provide for performing this driving via a transmission element connected to the rake, like the finger 94, driving the shaft once the rakes have fallen on their snails.

The invention claimed is:

1. A ringing mechanism comprising a power source for driving rakes and a gear connecting the power source to a regulation member, wherein the rakes are kinematically connected to the power source via a differential arranged in the gear, wherein the differential comprises a first input wheel kinematically connected to the gear and a second input wheel connected to a control member and an output wheel connected to the rakes.

2. The mechanism of claim 1, wherein the control member is arranged such that the differential can occupy:

a first configuration in which the first input wheel is blocked in rotation and the second input wheel (24) is free in rotation, the output wheel (30) being free in rotation, a second configuration in which the first input wheel is free in rotation, the second input wheel is blocked in rotation, the output wheel then being free to be driven via the first input wheel, and a third configuration in which the first and the second input wheels are blocked in rotation, the output wheel also being blocked in rotation.

3. The mechanism of claim 2, wherein the differential comprises, on a shaft:

a first solar wheel constituting the first input of the differential and kinematically connected with a wheel of the gear, at least one lower satellite meshing with the first solar wheel, a satellite-holder wheel free in rotation on the shaft and coaxial with the first solar wheel, constituting the second input of the differential, said lower satellite being mounted in rotation on a first level of the satellite-holder wheel, at least one upper satellite mounted in rotation on a second level of the satellite-holder wheel, mounted coaxial and integral in rotation with the lower satellite, an upper solar wheel, meshing with the upper satellite and constituting the output of the differential.

4. The mechanism of claim 3, wherein the control member is a camshaft comprising a first cam to block the first input wheel or leave it free in rotation, a second cam to block the second input wheel or leave it free in rotation and at least one drive train for pivoting of said shaft.

5. The mechanism according to claim 4, characterized in that it comprises a silencing device (100) provided with a bolt (108) capable of evolving between a first position and a second position, in which it cooperates with the drive train (90) in order to block the control member (50).

6. The mechanism according to claim 3, characterized in that it comprises a silencing device (100) provided with a bolt (108) capable of evolving between a first position and a second position, in which it cooperates with the drive train (90) in order to block the control member (50).

7. The mechanism of claim 2, wherein the control member is a camshaft comprising a first cam to block the first input wheel or leave it free in rotation, a second cam to block the second input wheel or leave it free in rotation and at least one drive train for pivoting of said shaft.

8. The mechanism according to claim 7, characterized in that it comprises a silencing device (100) provided with a bolt (108) capable of evolving between a first position and a second position, in which it cooperates with the drive train (90) in order to block the control member (50).

9. The mechanism of claim 2, wherein the first input wheel is connected to the control member via the gear, said first input wheel being blocked in rotation by the blocking of the gear, preferably by the blocking of the regulation member.

10. The mechanism of claim 1, wherein the control member is a camshaft comprising a first cam to block the first input wheel or leave it free in rotation, a second cam to block the second input wheel or leave it free in rotation and at least one drive train for pivoting of said shaft.

11. The mechanism of claim 10, comprising a mechanism for triggering the striking-mechanism, wherein said triggering mechanism comprises a finger for driving the drive train.

12. The mechanism of claim 10, comprising a first transmission element to drive the shaft via the drive train after the rakes have fallen on their snails.

13. The mechanism of claim 10, comprising a second transmission element to drive the shaft via the drive train after the ringing has taken place.

14. The mechanism according to claim 10, characterized in that it comprises a silencing device (100) provided with a bolt (108) capable of evolving between a first position and a second position, in which it cooperates with the drive train (90) in order to block the control member (50).

15. The mechanism of claim 1 in which the second input wheel is provided with a peripheral toothing, said second input wheel being able to be blocked in rotation by a lever cooperating with the control member.

16. The mechanism according to claim 1, characterized in that it comprises a silencing device (100) provided with a bolt (108) capable of evolving between a first position and a second position, in which it cooperates with the drive train (90) in order to block the control member (50).

17. The mechanism of claim 16, wherein a manual control means is arranged to put the bolt of the silencing device in its second position.

18. The mechanism of claim 16, wherein an automatic control means is arranged to put the bolt of the silencing device in its second position.

19. The mechanism according to claim 2, characterized in that it comprises a silencing device (100) provided with a bolt (108) capable of evolving between a first position and a second position, in which it cooperates with the drive train (90) in order to block the control member (50).

* * * * *